US011396813B2

(12) United States Patent
Gimel et al.

(10) Patent No.: US 11,396,813 B2
(45) Date of Patent: Jul. 26, 2022

(54) ROUGH CAST BLADING WITH MODIFIED TRAILING EDGE GEOMETRY

(71) Applicant: SAFRAN AIRCRAFT ENGINES, Paris (FR)

(72) Inventors: Alexandre Gimel, Moissy-Cramayel (FR); Josserand Jacques André Bassery, Moissy-Cramayel (FR); Maxime Paul Numa Givert, Moissy-Cramayel (FR); Gabriela Mihaila, Moissy-Cramayel (FR); Marc Soisson, Moissy-Cramayel (FR); Ba-Phuc Tang, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 47 days.

(21) Appl. No.: 17/055,364

(22) PCT Filed: May 23, 2019

(86) PCT No.: PCT/FR2019/051180

§ 371 (c)(1),
(2) Date: Nov. 13, 2020

(87) PCT Pub. No.: WO2019/224486

PCT Pub. Date: Nov. 28, 2019

(65) Prior Publication Data

US 2021/0215047 A1 Jul. 15, 2021

(30) Foreign Application Priority Data

May 23, 2018 (FR) ..... 1854282

(51) Int. Cl.

| | |
|---|---|
| ***F01D 5/14*** | (2006.01) |
| ***B22C 7/02*** | (2006.01) |
| ***B22D 25/02*** | (2006.01) |

(52) U.S. Cl.
CPC ..... *F01D 5/141* (2013.01); *B22C 7/02* (2013.01); *B22D 25/02* (2013.01);
(Continued)

(58) Field of Classification Search
None
See application file for complete search history.

(56) References Cited

U.S. PATENT DOCUMENTS

| | | | | |
|---|---|---|---|---|
| 8,414,265 | B2 * | 4/2013 | Willett, Jr. | F01D 5/145 416/228 |
| 10,260,361 | B2 * | 4/2019 | Botrel | F01D 5/02 |

(Continued)

FOREIGN PATENT DOCUMENTS

| | | | |
|---|---|---|---|
| CN | 104246635 | A | 12/2014 |
| EP | 1930097 | A1 | 6/2008 |
| FR | 2794167 | A1 | 12/2000 |

OTHER PUBLICATIONS

International Search Report in corresponding Application No. PCT/FR2019/051180, dated Aug. 21, 2019, (4 pages).

*Primary Examiner* — Courtney D Heinle
*Assistant Examiner* — Jason Fountain
(74) *Attorney, Agent, or Firm* — Bookoff McAndrews, PLLC

(57) ABSTRACT

A rough cast blading of this blade includes, a suction sidewall and/or a pressure sidewall of this blading intended to respectively form the suction sidewall and/or the pressure sidewall of the blade, a casting allowance extending over a determined width from a trailing edge of the blading intended to form the trailing edge of the blade in the direction of a leading edge of the blading intended to form the leading edge of the blade, except for a reserved area adjacent to the trailing edge of the blading and whose width (Continued)

is at least one radius of the trailing edge of the blading, over at least part of the height of the blading.

10 Claims, 1 Drawing Sheet

(52) U.S. Cl.
CPC ..... *F05D 2220/32* (2013.01); *F05D 2230/21* (2013.01); *F05D 2240/30* (2013.01)

(56) References Cited

U.S. PATENT DOCUMENTS

| | | | | |
|---|---|---|---|---|
| 2011/0091327 | A1* | 4/2011 | Willett, Jr. ..... | F01D 5/20 416/235 |
| 2014/0003952 | A1 | 1/2014 | Cheah | |
| 2015/0218962 | A1 | 8/2015 | Weber et al. | |
| 2015/0361808 | A1* | 12/2015 | Botrel ..... | F01D 5/20 415/208.1 |

* cited by examiner

ROUGH CAST BLADING WITH MODIFIED TRAILING EDGE GEOMETRY

CROSS-REFERENCE TO RELATED APPLICATION(S)

This application is the U.S. national phase entry under 35 U.S.C. § 371 of International Application No. PCT/FR2019/051180, filed on May 23, 2019, which claims priority to French Patent Application No. 1854282, filed on May 23, 2018.

BACKGROUND OF THE INVENTION

The present invention relates to the general field of turbomachine turbine blading, and more particularly to the rough cast blading of turbine blades produced by the lost-wax casting technique.

In a manner known per se, a turbomachine includes a combustion chamber in which air and fuel are mixed before being burned therein. The gases derived from this combustion flow downstream of the combustion chamber and then supply a high-pressure turbine and a low-pressure turbine. Each turbine includes one or more rows of vanes (called diffusers) alternating with one or more rows of blades (called movable wheels), spaced circumferentially all around the rotor of the turbine.

FIG. 4A partly illustrates a conventional structure of diffusers currently fitted to numerous aircraft engines and including a plurality of vanes.

Each of these vanes 10 includes an aerodynamic profile or an airfoil inserted between an outer platform 14 joining the vane tips and an inner platform 16 joining the vane roots. Each airfoil includes a leading edge 18 and a trailing edge 20 opposite each other and pressure 22 and suction 24 sidewalls extending radially between a vane root and a vane tip along a direction XX' of elongation of the airfoil, which direction of elongation is perpendicular to the longitudinal central axis (not represented) of the turbomachine.

FIG. 4B illustrates a conventional hollow movable blade 30 for a gas turbine including an aerodynamic profile or an airfoil having a leading edge 32 and a trailing edge 34 opposite each other and connected by a pressure sidewall 36 and a suction sidewall 38 extending radially between a blade root 40 and a blade tip 42 along the direction XX' of elongation of the airfoil.

It is known that the trailing edge of such vanes or blades is a key dimensional characteristic for the aerodynamic performance of the turbine and the engine. Therefore, to reduce the fuel consumption of the engine, a known solution consists in increasing the aerodynamic performance of the turbine by thinning the trailing edge of these blades.

However, currently the turbine blading is produced essentially according to a lost-wax casting technique. Given the thinness of the desired aerodynamic profile, this casting technique alone does not allow obtaining blading with a thin trailing edge and an additional subsequent polishing step is therefore used to mechanically adjust the trailing edge and thus be able to thin it. Unfortunately, it appeared that such an additional material removal step to the rough cast blade did not allow complying with the final shape of the aerodynamic profile and its dimensional tolerances. Indeed, the polishing of a thin surface generates the heating then a local deformation of the aerodynamic profile whose shape is no longer respected, whether it is the tangency or the radius of the trailing edge, which will then lead to a degradation of the performances of the turbine, therefore as opposed to what is desired.

OBJECT AND SUMMARY OF THE INVENTION

The present invention therefore aims at overcoming the drawbacks related to the deformation of the trailing edge during the polishing of the trailing edge by proposing a modification of the process for elaboration of the blade by lost-wax casting which does not generate dimensional unconformities and allows complying with the desired shape of the aerodynamic profile.

For this purpose, there is provided a rough cast blading of a turbomachine blade produced according to the lost-wax technique, the blade including an airfoil having a leading edge and a trailing edge opposite each other and connected by a pressure sidewall and a suction sidewall extending between a blade root and a blade tip, characterized in that, in order to produce on said blade a thin trailing edge which is not deformed by a subsequent material removal operation, said rough cast blading of said blade includes on a suction sidewall and/or a pressure sidewall of said blading intended to respectively form said suction sidewall and/or said pressure sidewall of the blade, a casting allowance extending from a trailing edge of said blading intended to form said trailing edge of the blade over a determined width in the direction of a leading edge of said blading intended to form said leading edge of the blade, except for a reserved area adjacent to said trailing edge of the blading and whose width is at least one radius of said trailing edge of the blading, over at least part of the height of the blade.

Thus, by locally thickening the profile of the rough cast blading, the casting process turns out to be more robust at the trailing edge and can therefore withstand subsequent material removal such as a polishing without risk of deformation of the blade.

According to the embodiment envisaged, said casting allowance is made over the entire height of the blading.

Preferably, said casting allowance has a variable thickness which decreasingly varies over said determined width between a first value equal to zero and a second value comprised between half and once the thickness $\underline{e}$ desired for the blade and determined at a predetermined distance $\underline{d}$ from said trailing edge of the blade.

Advantageously, said first value is determined at a first junction line, parallel to said trailing edge of the blading and constituting a line of tangency between said casting allowance and said suction sidewall of the blading, and said second value is determined at a second junction line also parallel to the trailing edge of the blading and delimiting said reserved area.

Preferably, said casting allowance joins said suction sidewall of the blading at a first edge along said line of tangency and at second, third and fourth edges by sloping connections.

Advantageously, said sloping connections each include a slope comprised between 20° and 50°.

Preferably, said line of tangency is parallel to said trailing edge and located at a distance from said trailing edge of the blading equal to 40 to 60% of a chord length $\underline{L}$ of the blading.

The invention also relates to a method for manufacturing a turbomachine blade produced according to the lost-wax casting technique, the blade including a hollow airfoil having a leading edge and a trailing edge opposite each other and connected by a pressure sidewall and a suction sidewall extending between a blade root and a blade tip, the method being characterized in that, in order to produce by casting a blade with a thin trailing edge, it comprises on the one hand a step including the production of a rough cast blading with a casting allowance of variable thickness at a suction sidewall and/or a pressure sidewall of said blading intended to form respectively said suction sidewall and/or said pressure sidewall of the blade and extending from a trailing edge of said blading intended to form said trailing edge of the blade and in the direction of a leading edge of the blading intended to form said leading edge of the blade, except for a reserved area adjacent to said trailing edge of the blading and whose width is at least one radius of said trailing edge of the blading, and on the other hand a step of subsequent material removal of this casting allowance.

Preferably, said casting allowance is made over all or part of the height of the blading.

Advantageously, said material removal operation is a polishing.

The invention also relates to a turbomachine including a blade manufactured according to the aforementioned manufacturing method.

BRIEF DESCRIPTION OF THE DRAWINGS

Other characteristics and advantages of the present invention will emerge from the description given below, with reference to the appended drawings which illustrate an exemplary embodiment thereof without any limitation and on which.

DETAILED DESCRIPTION OF EMBODIMENTS

Figure 1:
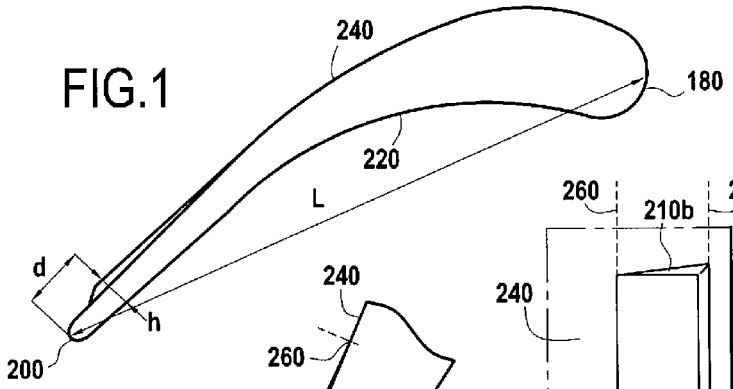
FIG. 1 illustrates the aerodynamic profile of a turbine blade according to the invention.
Figure 2:
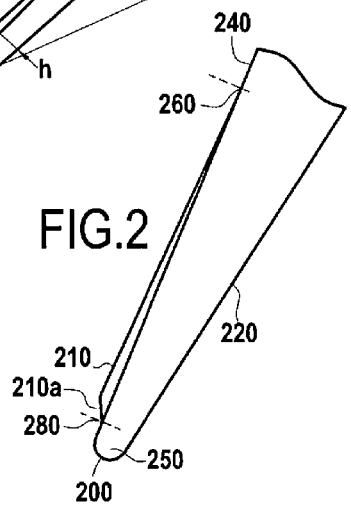
FIG. 2 is a partial sectional view of the blade of FIG. 1 at the trailing edge.

FIGS. 1 and 2 represent an aerodynamic profile or airfoil of a rough cast blading intended to form a turbine blade including a leading edge 18 and a trailing edge 20 opposite each other and connected by a pressure sidewall 22 and a suction sidewall 24 extending between a blade root and a blade tip. For the clarity of the description which follows, the elements of the rough cast blading have the same numbers as those of the finished blade to within a factor of 10. Thus, a leading edge of the rough blading 180 corresponds to the leading edge of the finished blade 18, a trailing edge of the rough blading 200 corresponds to the trailing edge of the finished blade 20, a pressure sidewall of the rough blading 220 corresponds to the pressure sidewall of the finished blade 22 and a suction sidewall of the rough blading 240 corresponds to the suction sidewall of the finished blade 24.

In accordance with the invention, in order to allow the production on the finished blade of a thin trailing edge, that is to say whose thickness measured at 1 mm from the end of this trailing edge is comprised between 0.2 mm and 0.5 mm, it is proposed during the casting operation to locally thicken the aerodynamic profile of the rough cast blading, that is to say to add to this casting model a casting allowance 210 over a determined width of the pressure sidewall 220 and/or of the suction sidewall 240 extending from the trailing edge 200 in the direction of the leading edge 180, except, however, for a determined reserved area 250 adjacent to this trailing edge 200 and whose width is at least one radius of the trailing edge, but over all or part of the height of the blading, so that this trailing edge is not modified and therefore is not impacted, in particular not deformed by the material removal operation such as a polishing which will follow this casting operation. In order not to jeopardize the aerodynamic performance and to simplify the tooling, the casting allowance is however disposed advantageously on the suction sidewall of the rough blading 240.

It will be noted that the value of 1 mm from the end of the trailing edge is a determined threshold for measuring and adjust the thickness of the trailing edge while maintaining a safety margin with respect to this end. Indeed, insufficiently controlled machining of the trailing edge would risk machining the end of the trailing edge and therefore shortening the chord length $\underline{L}$ of the airfoil, which would have a significant impact on aerodynamic performance.

This substantially rectangular casting allowance 210 has over the determined width a variable thickness which decreasingly varies between a first value equal to zero (h=0) present on the suction sidewall 240 at a first junction line 260 forming a first edge of this casting allowance, parallel to the trailing edge 200, and a second value comprised between half and once the desired thickness $\underline{e}$ of the blade ($0.4\ e<h<e$), the casting allowance joining the suction sidewall 240 by a sloping connection 210*a* (ideally comprised between 20° and 50° so as to be large enough to increase the trailing edge without harming the injection of the wax and the flowability of the metal) at a second junction line 280 delimiting the reserved area 250, also parallel to the trailing edge 200 and forming a second edge opposite the first edge. This makes the casting operation more robust and the material removal operation is facilitated because the radius of the trailing edge remains rough cast. The desired thickness $\underline{e}$ of the blade is defined at a predetermined distance $\underline{d}$ from the trailing edge 20 of this blade. Thus, as specified in the previous paragraph, taking as the distanced a value of 1 mm, for a desired trailing edge thickness $\underline{e}$ of 0.5 mm, those skilled in the art will choose a casting allowance $\underline{h}$ comprised between 0.2 mm and 0.5 mm.

Considering $\underline{L}$ as the chord length of the blade, the first junction line 260 is preferably located at a distance from the trailing edge 200 equal to 40 to 60% of this length $\underline{L}$. Thus, those skilled in the art will for example choose a distance from 10 mm to 15 mm for a chord length of 25 mm. In addition, to avoid any jumps and obtain the desired zero thickness, this first junction line must constitute a line of tangency between the two tangent surfaces formed by the outer face of the casting allowance and the outer face of the suction sidewall.

Likewise, the second junction line 280 defining the end of the reserved area 250 must be far enough from the trailing edge to avoid the deformation of this trailing edge but also relatively close so as not to jeopardize the lost-wax casting operation. Indeed, if this second junction line 280 is too close to the trailing edge 200, then the aerodynamic profile will be deformed during the material removal operation because the machined strip will be too close to this desired thin trailing edge. And positioning the second junction line too far from the trailing edge would amount to making this thin trailing edge directly cast with the drawbacks mentioned above. Thus, those skilled in the art will choose a distance between the trailing edge 200 and this second junction line 280 which must be preferably comprised between 0.5 mm and 1 mm, that is to say on the order of 2 to 4 times the radius of the trailing edge which can be estimated at 0.25 mm for a thickness of 0.5 mm.

Figure 3:
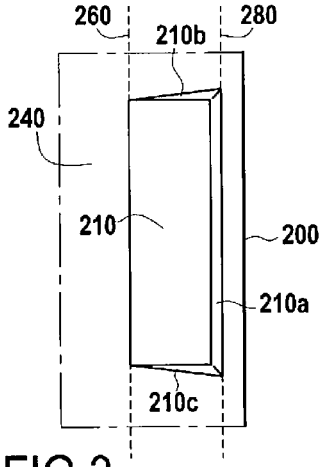
FIG. 3 is a partial elevational view of the blade of FIG. 1 at the suction sidewall.
Figure 4A:
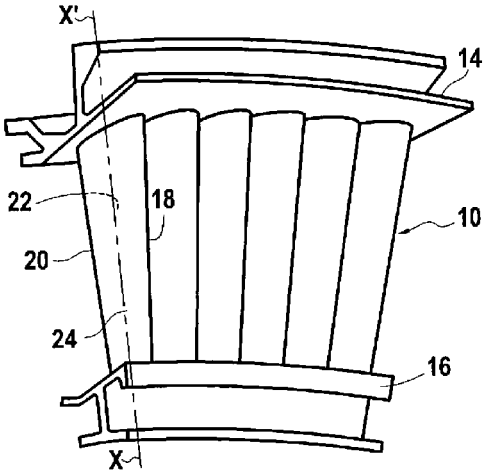
FIG.4A PRIOR ART
FIGS. 4A and 4B are perspective views of a diffuser part of the prior art showing a plurality of vanes and a blade of a turbine of the prior art, respectively.
Figure 4B:
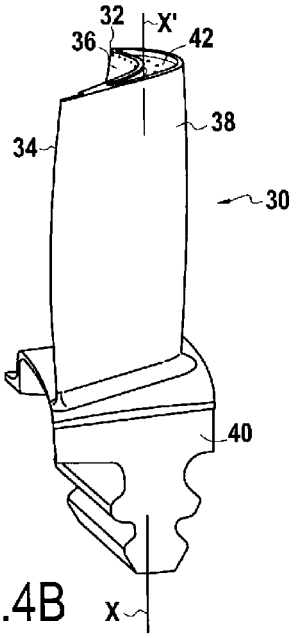
FIG.4B PRIOR ART

FIG. 3 illustrates more specifically the casting allowance 210 which extends over the suction sidewall 240 of the rough blading, parallel to the trailing edge 200, between the first 260 and second 280 junction lines. In the perpendicular plane, over the height of the blading, this casting allowance also has junctions with the suction sidewall 240 forming third and fourth edges opposite each other and defining towards the blade tip a sloping connection 210*b* and towards the blade root a sloping connection 210*c*.

The method for manufacturing a turbine blade according to the invention produced according to the lost-wax casting technique does not differ from the conventional method in that it requires the production of a wax model and a ceramic mold, the pouring of the metal constituting the blade as a replacement for the wax previously introduced into the mold then being liquefied by heating before demolding the blade. The only difference lies in the manufacture of the wax model which therefore includes a casting allowance of variable thickness at the suction sidewall of the blade intended to facilitate the casting of a thin trailing edge (whose radius therefore remains rough cast) and to be removed by a subsequent material removal operation such as polishing.

This modification of the aerodynamic profile of the rough casting blading by the addition of a casting allowance makes it possible to pave the way for a new industrialization process to obtain thin trailing edges with the lowest possible aerodynamic impact on this polishing operation.

The invention claimed is:

1. A method for manufacturing a turbomachine blade produced according to the lost-wax casting technique, the blade including an airfoil having a leading edge and a trailing edge opposite each other and connected by a pressure sidewall and a suction sidewall extending between a blade root and a blade tip, the method being wherein, in order to produce by casting a blade with a thin trailing edge, it comprises on the one hand a step including the production of a rough cast blading with a casting allowance of variable thickness at a suction sidewall and/or a pressure sidewall of said blading intended to form respectively said suction sidewall and/or said pressure sidewall of the blade and extending from a trailing edge of said blading intended to form said trailing edge of the blade and in a direction of a leading edge of said blading intended to form said leading edge of the blade, except for a reserved area adjacent to said trailing edge of the blading and whose width is at least one radius of said trailing edge of the blading, and on the other hand a step of subsequent material removal of this casting allowance.

2. The manufacturing method according to claim 1, wherein said casting allowance is made over all or part of a height of the blading.

3. The manufacturing method according to claim 1, wherein said material removal operation is a polishing.

4. A turbomachine including a blade manufactured according to the manufacturing method of claim 1.

5. A blade manufactured according to the manufacturing method of claim 1.

6. The manufacturing method according to claim 1, wherein the variable thickness decreasingly varies over said determined width between a first value equal to zero and a second value comprised between a half and once the thickness e desired for the blade and determined at a predetermined distance d from said trailing edge of the blade.

7. The manufacturing method according to claim 6, wherein said first value is determined at a first junction line, parallel to said trailing edge of the blading and constituting a line of tangency between said casting allowance and said suction sidewall of the blading, and said second value is determined at a second junction line also parallel to the trailing edge of the blading and delimiting said reserved area.

8. The manufacturing method according to claim 7, wherein said casting allowance joins said suction sidewall of the blading at a first edge along said line of tangency and at second, third and fourth edges by sloping connections.

9. The manufacturing method according to claim 8, wherein said sloping connections each include a slope comprised between 20° and 50°.

10. The manufacturing method according to claim 7, wherein said line of tangency is parallel to said trailing edge of the blading and located at a distance from said trailing edge of the blading equal to 40 to 60% of a chord length L of the blading.

* * * * *